US008746354B2

(12) United States Patent
Head

(10) Patent No.: US 8,746,354 B2
(45) Date of Patent: Jun. 10, 2014

(54) WET CONNECTION SYSTEM FOR DOWNHOLE EQUIPMENT

(75) Inventor: Philip Head, Egham (GB)

(73) Assignee: Artificial Lift Company Limited, Egham (GB)

( * ) Notice: Subject to any disclaimer, the term of this patent is extended or adjusted under 35 U.S.C. 154(b) by 695 days.

(21) Appl. No.: 13/014,055

(22) Filed: Jan. 26, 2011

(65) Prior Publication Data

US 2011/0180272 A1 Jul. 28, 2011

(30) Foreign Application Priority Data

Jan. 26, 2010 (GB) ..... 1001232.6

(51) Int. Cl.
*E21B 23/00* (2006.01)

(52) U.S. Cl.
USPC ..... 166/381; 166/65.1

(58) Field of Classification Search
USPC ..... 166/381, 65.1, 380, 105, 68
See application file for complete search history.

(56) References Cited

U.S. PATENT DOCUMENTS 5,769,160 A 6/1998 Owens
2003/0015324 A1 1/2003 Uhlenkott
2007/0284117 A1 12/2007 Smithson
2008/0245536 A1 10/2008 Stoesz
2011/0030972 A1* 2/2011 Brookbank ..... 166/381

FOREIGN PATENT DOCUMENTS

GB 2 264 315 A 8/1993
GB 2 318 167 A 4/1998
GB 2 366 817 B 6/2003

OTHER PUBLICATIONS

GB Search Report, Application No. GB1001232.6, Apr. 20, 2010.

* cited by examiner

*Primary Examiner* — William P Neuder
(74) *Attorney, Agent, or Firm* — Greenberg Traurig, LLP

(57) ABSTRACT

A wet connection system suitable for use in hydrocarbon wells preferably comprises one or more elongate, small diameter conduits (50) which extend down the wellbore (2) and terminate adjacent a locating structure (11) on the production tubing (10). Equipment (70) deployed at the locating structure is connected to one or more self supporting conductors (30) which extend down the conduits from the wellhead (5). Preferably the conductors are retractable and the conduits are sealingly connected to the equipment, allowing the equipment and conductors to be deployed and recovered independently of each other and to be flushed with dielectric oil (99) pumped down the conduits after re-connection.

23 Claims, 11 Drawing Sheets

30
17
21
33
32
31
83
34
100
87
100'
80
82
86
82'
91
92
93

50
17
21
20
19
22
80

WET CONNECTION SYSTEM FOR DOWNHOLE EQUIPMENT

CROSS-REFERENCE TO RELATED APPLICATIONS

This application claims priority to, and the benefit of, United Kingdom patent application no. GB 1001232.6, filed on 26 Jan. 2010, the entirety of which is hereby incorporated by reference.

BACKGROUND

1. Field of the Invention

This invention relates to wet connection systems for connecting a conductor or conductors to equipment deployed in a borehole, for example, an oil or gas well.

2. Related Art

Wet connection systems known in the art provide a connection that can be made and unmade in-situ in a liquid environment so that the deployed equipment can be disconnected and recovered without removing the conductor from the borehole, and then re-connected to the conductor in situ when the equipment is re-deployed.

Commonly, the or each conductor is an electrical conductor, which may be used for example to provide a data connection or to supply power to a tool or equipment such as an electric submersible pump assembly (ESP). In other applications, the or each conductor may comprise for example a fibre-optic conductor or a tube for conducting pressurised hydraulic fluid to supply power to a tool deployed in the borehole. Usually, an oil or gas well will be lined with tubing that is cemented into the borehole to form a permanent well casing, the inner surface of the tubing defining the wellbore. (In this specification, a "tube" or "tubing" means an elongate, hollow element which is usually but not necessarily of circular cross-section, and the term "tubular" is to be construed accordingly.) The fluid produced from the well is ducted to the surface via production tubing which is usually deployed down the wellbore in jointed sections and (since its deployment is time consuming and expensive) is preferably left in situ for the productive life of the well. Where an ESP is used to pump the well fluid to the surface, it may be permanently mounted at the lower end of the production tubing, but is more preferably deployed by lowering it down inside the production tubing on a wireline or on continuous coiled tubing (CT), so that it can be recovered without disturbing the production tubing.

It is known for example from US 2003/0085815 A1 to provide a well casing with a docking station which is connected to the surface by conductors. The docking station and conductors are deployed together with the casing and permanently cemented into the borehole together with the casing. Tools deployed down the well may be releasably connected to the conductors via the docking station.

WO2005003506 to the present applicant discloses a wet connection system in which one or more conductors are arranged in the annular gap between a string of production tubing and a well casing and terminate at a connection structure fixed to the lower end of the production tubing. An ESP is lowered down the production tubing and connected with the conductors by an arm which moves radially outwardly to engage the connection structure.

In practice, the last mentioned system may be used to deploy an ESP or other equipment by remote control in an oil or gas well by connecting it to a connection structure on the production tubing at a depth of several kilometers in an aggressive environment in which it is subjected to high pressures and temperatures, heavy mechanical loading, vibration, corrosive fluids, dissolved gases which penetrate electrical insulation and particulates which can clog mechanical parts. Since the wet connection between the deployed equipment and the conductors is made and unmade in this environment, failure often occurs in the region of the wet connector assembly and, less frequently, in the conductors which connect it to the surface, and, where the conductors are electrical power conductors, most frequently in the insulation of the electrical conductors close to the point of connection. By unmaking the wet connection and recovering the deployed equipment to the surface, damaged connectors on the deployed equipment can be identified and repaired. However, damaged connectors at the lower end of the conductors can only be inspected and replaced by recovering the entire string of production tubing, which is laborious and expensive.

SUMMARY OF THE INVENTION

It is an object of the present invention to provide a method and apparatus for making a wet connection to downhole equipment, which addresses this problem.

In accordance with the various aspects of the present invention there are provided a system and a method as defined in the claims.

BRIEF DESCRIPTION OF THE DRAWINGS

Some illustrative embodiments of the invention will now be described, purely by way of example and without limitation to the scope of the claims, and with reference to the accompanying drawings, in which:

FIG. 5A: the conductor;

FIG. 5B: the conductor disposed in the conduit;

FIG. 5C: the receptacle aligned with the conductor and conduit;

FIG. 5D: the conduit engaged with the receptacle prior to connection of the conductor;

FIG. 5E: the conduit engaged with the receptacle after connection of the conductor; and FIG. 5F: the conduit engaged with the receptacle after retraction of the conductor;

FIG. 9A: the conduit and receptacle prior to connection of the conductor;

FIG. 9B: the conduit and receptacle after connection of the conductor;

FIG. 9C: an enlarged view of the receptacle after connection of the conductor;

FIG. 9D: an enlarged view of the receptacle before connection of the conductor; and FIG. 9E: an enlarged view of the lower end of the conductor and conduit prior to connection of the conductor;

Corresponding reference numerals indicate corresponding parts in each of the figures.

DETAILED DESCRIPTION

Figure 1:
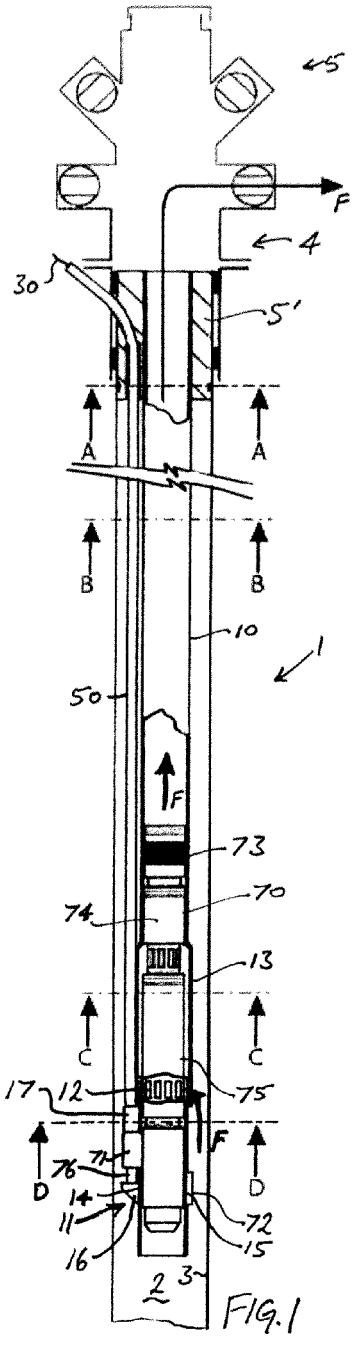
FIG. 1 is a longitudinal section through a borehole in accordance with a first embodiment.

Referring to FIGS. 1-4, in accordance with a first embodiment, a system is provided for connecting a group of three elongate electrical conductors 30 to supply three-phase power to an ESP 70 deployed down the wellbore 2 of a borehole 1. The wellbore 2 is defined by tubing 3 which is cemented into the borehole to form a fixed casing, typically having a diameter of around 175 mm. A string of jointed production tubing 10 extends down the wellbore from the wellhead assembly 5 at the upper end 4 of the borehole. A locating structure 11 is disposed on the lower end portion of the production tubing, which is provided with inlet holes 12 just above the locating structure. In the arrangement shown in FIG. 1, the inlet holes are located in an enlarged diameter portion 13 of the production tubing 10, whereas in the variant of FIGS. 2A and 2B, the production tubing 10 is of uniform diameter.

The locating structure 11 (best seen in FIG. 2A) comprises windows 14, 15 formed in the wall of the tubing 10 and an outwardly extending abutment 16. A group of three connection blocks 17 are attached to the production tubing 10 proximate the locating structure 11 and just above the upper edge of the window 14.

In use, the ESP 70 is lowered down the borehole (for example, on a wireline) through the production tubing 10 until a locating element 72 on its outer casing slidingly engages an orienting structure (not shown) on the production tubing which receives the ESP causing it to rotate into the correct position with respect to the locating structure as it descends. Such orienting structures are within the purview of those skilled in the art, and may include by way of example a shoulder or abutment surface extending around the internal surface of the production tubing and inclined with respect to its longitudinal (vertical) axis so as to define, for example, a helix, or alternatively an ellipse whose major axis lies in a plane containing the longitudinal axis of the production tubing and whose minor axis lies on a diameter thereof.

Figure 2A:
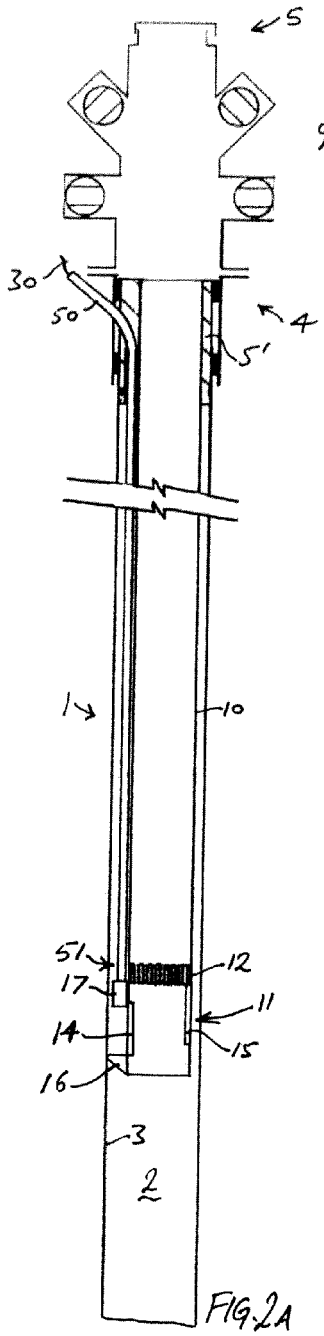
FIGS. 2A and 2B are longitudinal sections through a borehole in accordance with a variant of the first embodiment, respectively before and after deployment of an ESP.
Figure 2B:
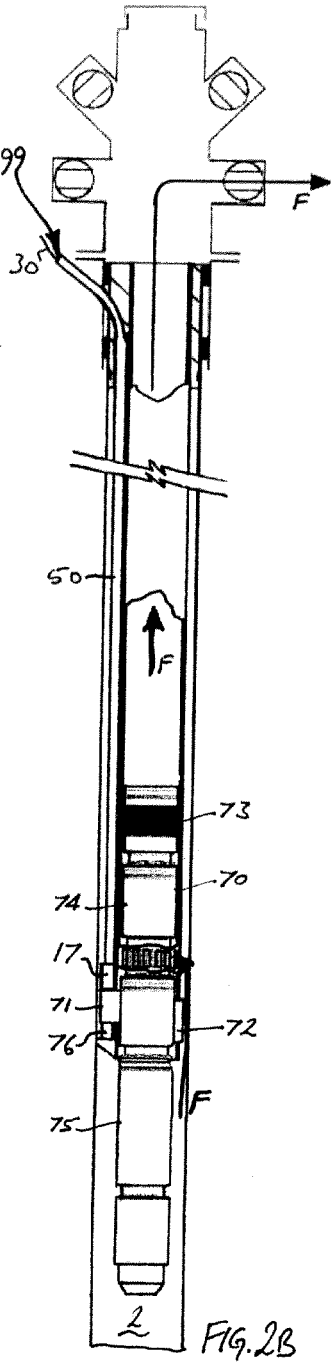
Figure 3A:
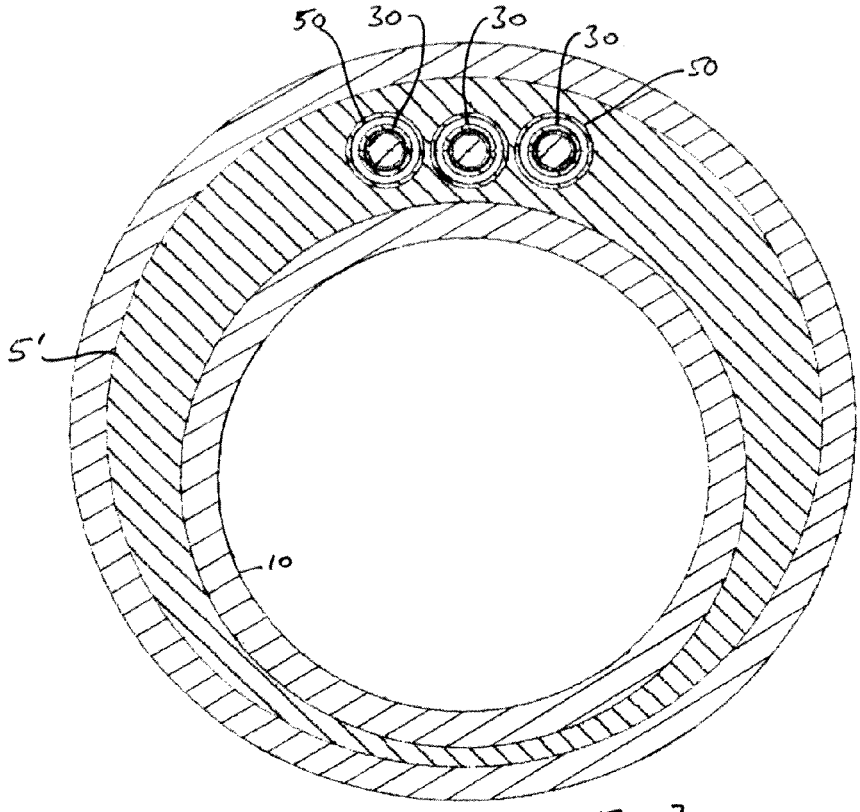
FIGS. 3A, 3B, 3C and 3D are cross-sections taken respectively at A-A, B-B, C-C and D-D through the borehole of FIG. 1.
Figure 3B:
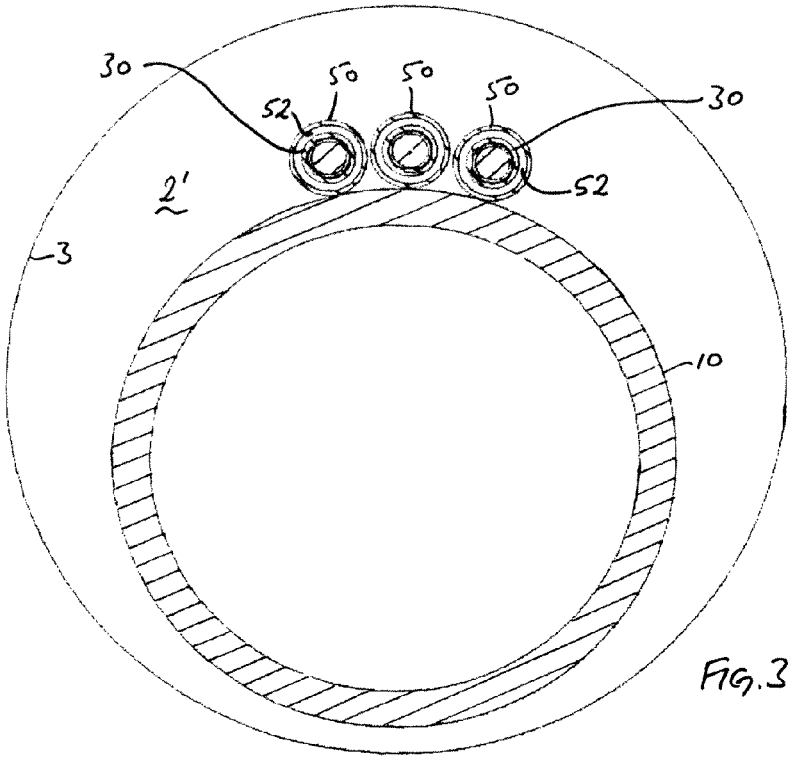
Figure 3C:
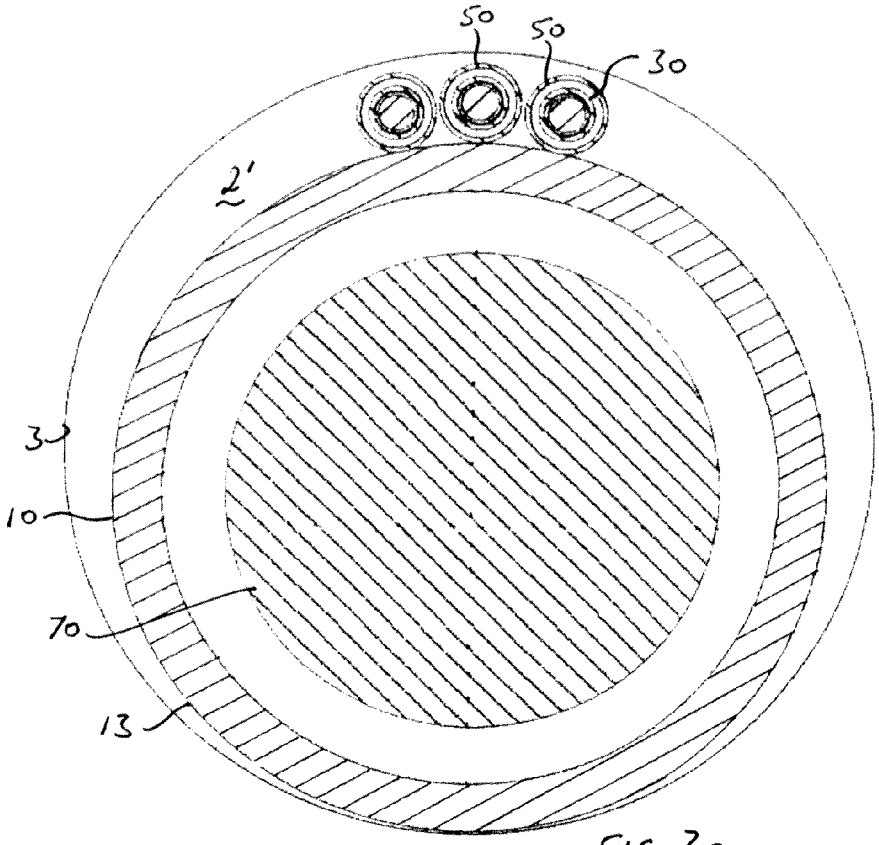
Figure 3D:
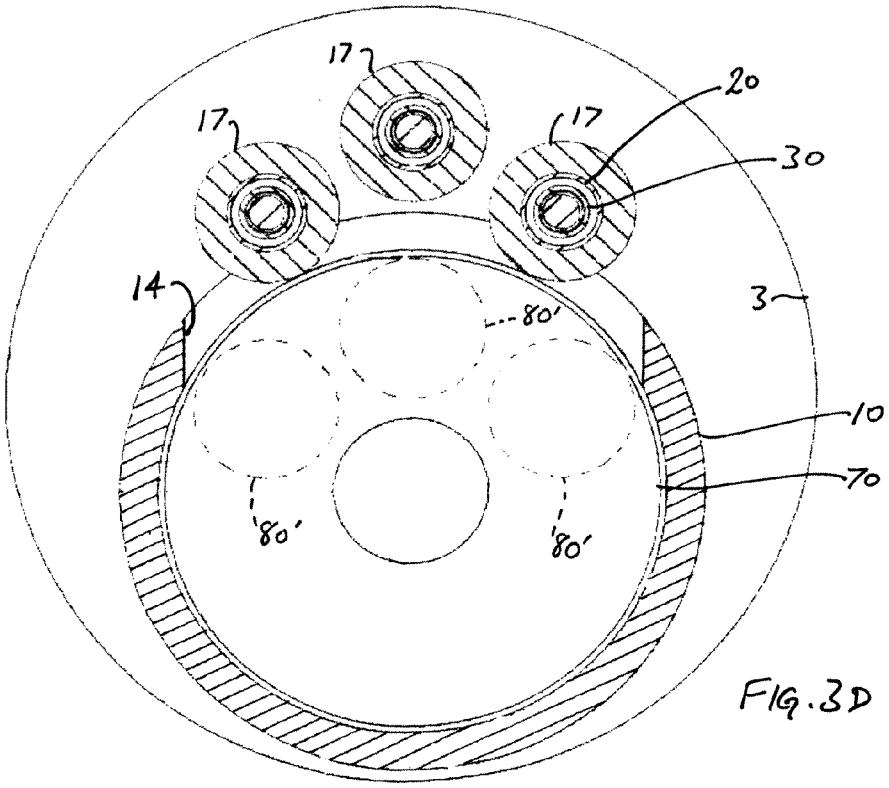
Figure 4:
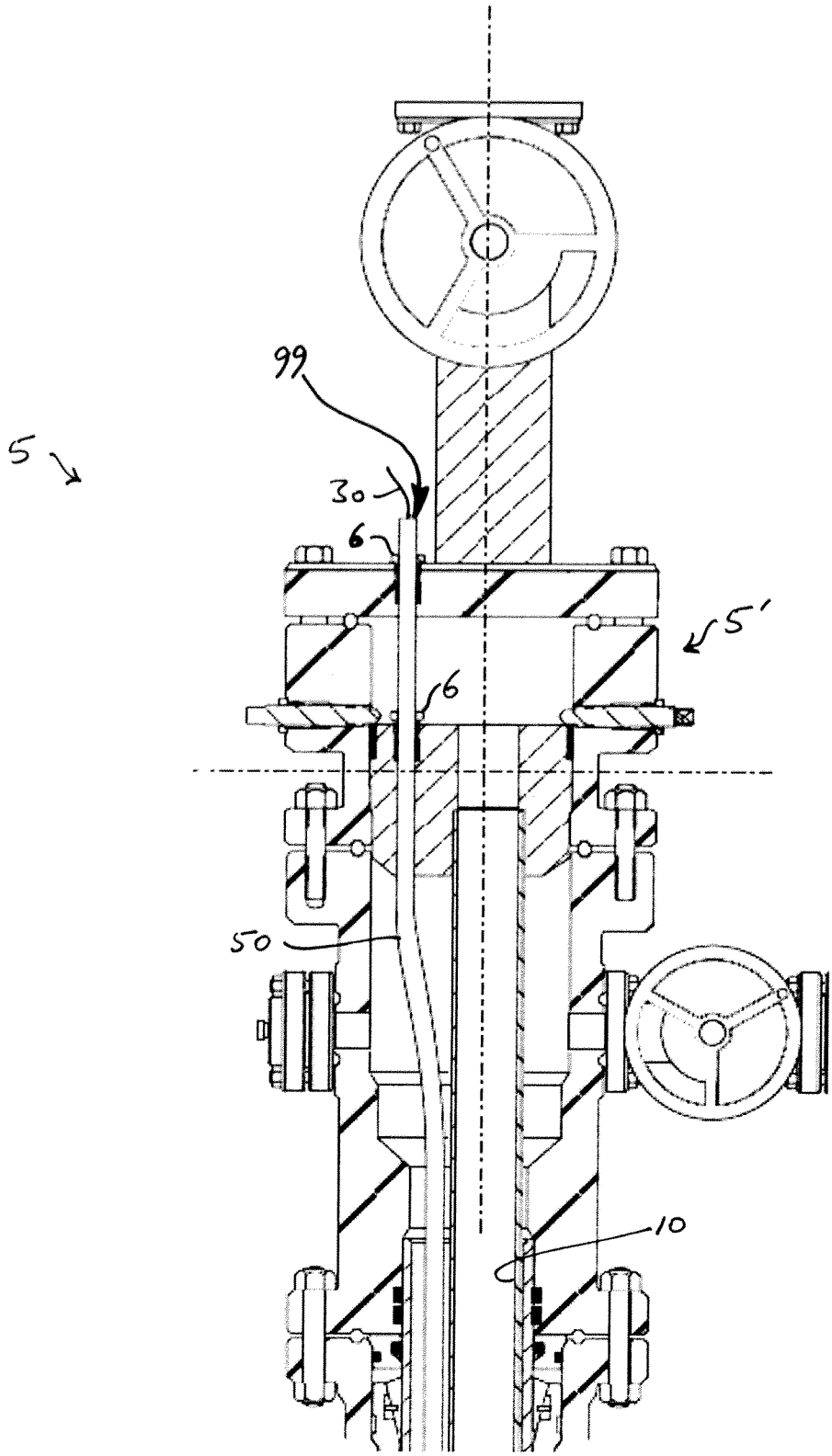
FIG. 4 is a longitudinal section through a wellhead.

A connection arm 71 and the locating element 72 are then extended radially outwardly from the ESP to engage respectively in the windows 14, 15 so as to locate the ESP and support it in the deployed position inside the production tubing at the locating structure as shown in FIGS. 1 and 2B, and to react the downward thrust produced by the ESP (which may be for example 20 tonnes or more) against the production tubing. The connection arm 71 comprises three connectors comprising receptacles 80 which are extended radially outwardly from the retracted position 80' (shown in broken lines in FIG. 3D) through the window 14 to lie axially beneath the three connection blocks 17 in the extended position.

A hydraulic ram 76 (powered for example by a battery operated motor inside the ESP) is then extended from the connection arm 71 to engage the abutment 16 on the production tubing 10, raising the connection arm 71 so that the receptacles 80 are sealingly connected with the respective connection blocks 17 as further described below.

In operation, the ESP 70 is sealed to the internal surface of the production tubing 10 by an expanding packer 73, so that the fluid produced by the well (indicated in FIGS. 1 and 2B by arrows F) is pumped to the surface by the pump 74 via the production tubing. In the arrangement of FIG. 1, the pump motor 75 is cooled by the well fluid drawn through the enlarged diameter portion 13 of the production tubing, whereas in the variant of FIGS. 2A and 2B the pump motor 75 hangs down beneath the production tubing so that it is cooled by well fluid drawn up through the wellbore 2.

Three elongate tubular steel (e.g. stainless steel) conduits 50 (only one of which can be seen in FIGS. 1, 2 and 4) are arranged in the annular gap 2' between the production tubing 10 and the tubular well casing 3, each conduit extending from the upper end 4 of the borehole to the locating structure 11. Each conduit 50 may have an external diameter of, for example, from about 10 mm to not more than about 35 mm, much smaller than that of the production tubing, which will typically be around 100 mm or more in diameter. Each conduit is lowered into the borehole together with the production tubing from a continuous coil at the wellhead before being sealed at its upper end region by gland nuts 6 to the wellhead hanger assembly 5, and is supported between the upper end 4 of the borehole and the locating structure 11 by conventional bands or clamps (not shown) which attach it at spaced intervals in fixed relation to the outer surface of the production tubing 10. The lower end portion or region 51 of each conduit is fixed to the production tubing proximate the locating structure by a respective connection block 17.

Each of the conductors 30 is slidably disposed inside a respective conduit 50, and has an external diameter which is smaller than the internal diameter of the conduit by, for example, a few millimeters, so that a generally annular clearance gap 52 is defined between the conductor and the conduit. The clearance gap is preferably substantially less than the diameter of the conductor, comprising for example a radial gap of around 2.5 min all round the conductor, and small enough to ensure that the conductor remains substantially parallel with the wall of the conduit so as to prevent it from buckling or jamming. The clearance gap is just large enough to allow the conductor to be slidingly inserted and retracted into and from the conduit, and sufficient to allow a dielectric fluid, e.g. oil 99 or other protective fluid to be pumped from the surface down through the conduit around the conductor. (It will be understood of course that the clearance gap is much too small to provide a viable flow path for the fluid produced from the well.)

With the production tubing and conduits in place, each conductor 30 is deployed by inserting it into the conduit 50 at the upper end of the borehole and feeding it down the conduit until it reaches the connection block 17 so that it extends from the upper end 4 of the borehole to the locating structure 11. A seal (not shown) is provided between the conductor and the conduit proximate the wellhead.

Referring also to FIGS. 5A-5F, each connection block 17 terminates at its lower end in a nose 18 and has an internal bore 19 communicating with the conduit 50. The bore 19 is formed in an internal insulating ceramic sleeve 20 and defines an upper internal shoulder 21 and a lower internal shoulder 22.

Since each conductor 30 is preferably suspended from the upper end of the borehole so that it is self-supporting for its entire length, for depths of about 1 km or more each conductor preferably comprises a high tensile strength steel core 31 surrounded by a cladding 32, preferably of copper, which is more electrically conductive than the core but has a lower tensile strength, and at least one outer layer of electrical insulation 33, which advantageously comprises an outer layer of thermoplastic over an inner layer of polyamide. Other arrangements are possible; e.g. the or each high tensile strength element can be arranged to surround the core, or a plurality of higher and lower tensile strength elements can be provided.

Figures 5A, 5B, 5C, 5D:
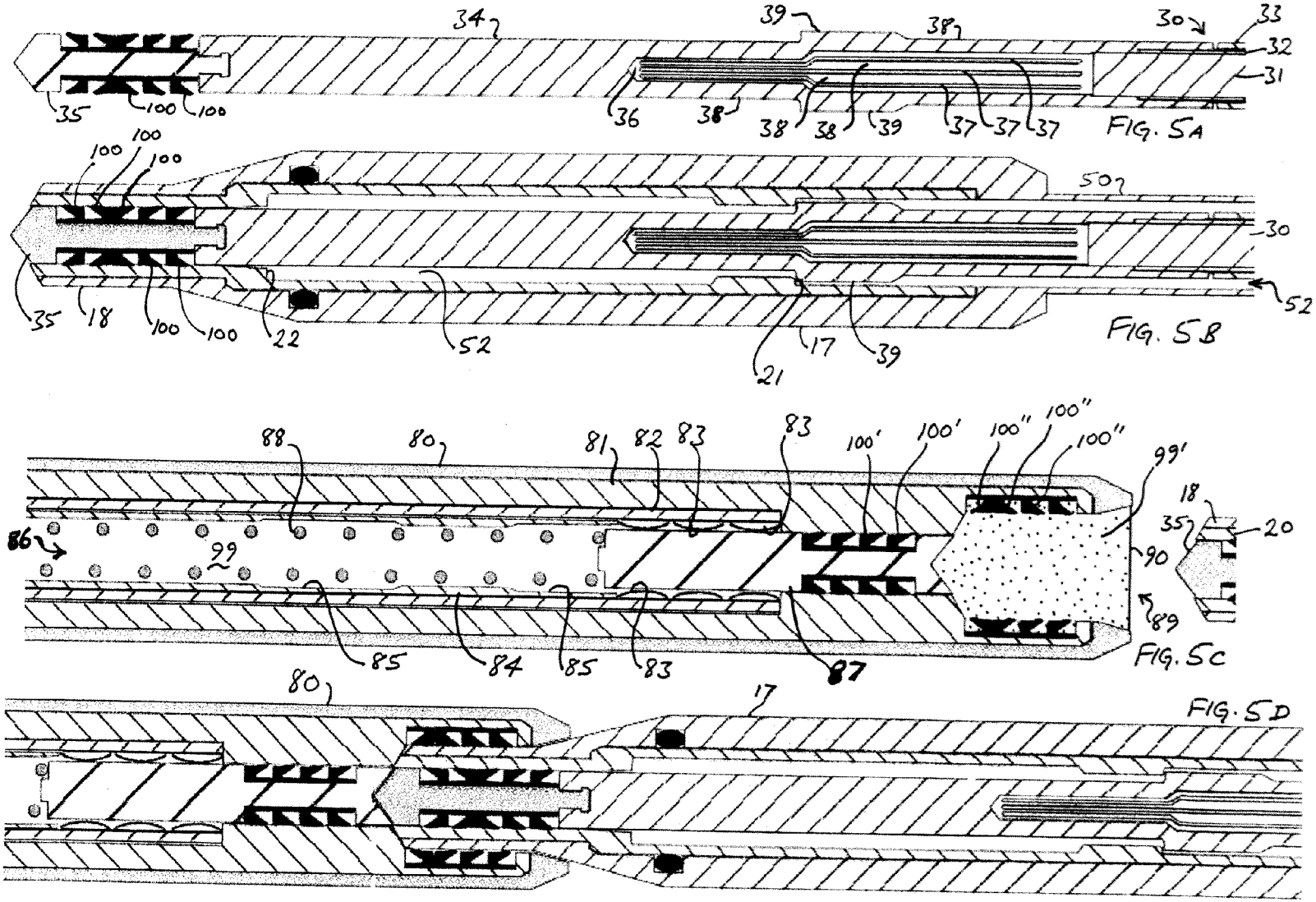
FIGS. 5A-5F are longitudinal sections through the lower end regions of a conductor and conduit and the cooperating receptacle of the ESP in accordance with the first embodiment, showing respectively.

The conductor terminates at its lower end in a terminal portion comprising a beryllium copper contact 34 which is attached to the core 31 and cladding 32, e.g. by brazing, welding or crimping, and which has a ceramic tip 35. An axial bore 36 extends part way along the contact, defining a cylindrical wall which is divided by axial slits 37 to form a plurality of axially elongate leaf springs 38. A collar 39 is defined on the outer side of each of the leaf springs, which engages the upper internal shoulder 21 of the connection block 17 to support the conductor in a first axial position in the conduit 50 (FIG. 5B). The collar 39 and the upper and lower internal shoulders 21, 22 cooperate to form a releasable abutment mechanism, as further described below.

In the first position as shown in FIG. 5B, a first group of annular seals 100 arranged on the ceramic tip 35 of the conductor engage the reduced diameter wall of the bore 19 within the nose 18. In the embodiment shown, each seal 100 functions as a wiper, as described in more detail below with reference to FIG. 10, and the seals are arranged facing in opposite directions so that in the first position (FIG. 5B) they seal the clearance gap 52 proximate the locating structure 11 so as to retain dielectric oil 99 within the clearance gap 52 and also to prevent the ingress of wellbore fluid into the conduit. The remainder of the bore 19 of the connection block 17 and the bore of the conduit 50 is of larger diameter than the seals 100, so that the clearance gap 52 is selectively sealable and unsealable proximate the locating structure 11 by sliding the conductor up or down the conduit 50 so as to move the seals out of engagement with the reduced diameter bore of the nose 18.

Each receptacle 80 includes an inner insulating ceramic sleeve 81 with an internal tubular conductor 82 terminating in a group of conventional electrical multi-connectors 83, and an inner insulating ceramic liner 84 with shallow annular recesses 85. The conductor and liner define a fluid passage 86 in which a ceramic plug 87 is slidingly received and biased to a closed position (FIG. 5C) by a spring 88. A shoulder (not shown) is provided to abut against the plug in the closed position, in which a second group of annular seals 100' mounted on the plug are arranged to sealingly engage the wall of the fluid passage 86. Each seal 100' is similar to the seals 100 and is arranged facing outwardly towards the orifice 89 of the receptacle so as to prevent the ingress of wellbore fluid. The receptacle terminates in an enlarged diameter portion having a third group of seals 100", also similar to the seals 100, which are arranged facing in opposite directions. The orifice 89 of the fluid passage 86 is closed by a protective membrane 90, and the space between the membrane and the plug is filled with a dielectric oil or other protective fluid, gel or cross-linked gel 99'.

As the connection arm 71 of the ESP is raised by the rain 76, the nose 18 of each connection block 17 (sealed by the ceramic tip 35 and seals 100 of the conductor 30 in the first position) ruptures the membrane 90 as it enters into the corresponding receptacle 80, sealingly connecting the conduit 50 to the receptacle so that the clearance gap 52 is in fluid communication with the fluid passage 86, together defining a fluid passageway (52, 86) that extends between the tool and the conduit and communicates with the clearance gap 52 and with the receptacle 80. The third seals 100" sealingly engage the nose 18 and wipe its surface as it enters the receptacle to prevent the ingress of wellbore fluid and prevent the loss of dielectric oil 99 from the fluid passage 86 (FIG. 5D). Each conduit is thus sealingly and remotely connectable to and disconnectable from the equipment while the equipment is in the deployed position.

When the collar 39 abuts against the upper internal shoulder 21 of the connection block 17, it supports the conductor 30 in the first position (FIGS. 5B and 5D) by reacting a part of the axial load applied by the conductor against the collar. This axial load is principally the weight of the conductor (extending for the entire depth of the wellbore), and is sensed at the surface as a reduction in the tensile load on the equipment used to deploy it. The conductor 30 is retained in the first position by stopping the deployment when this reduction in load is sensed.

Figures 5E, 5F:
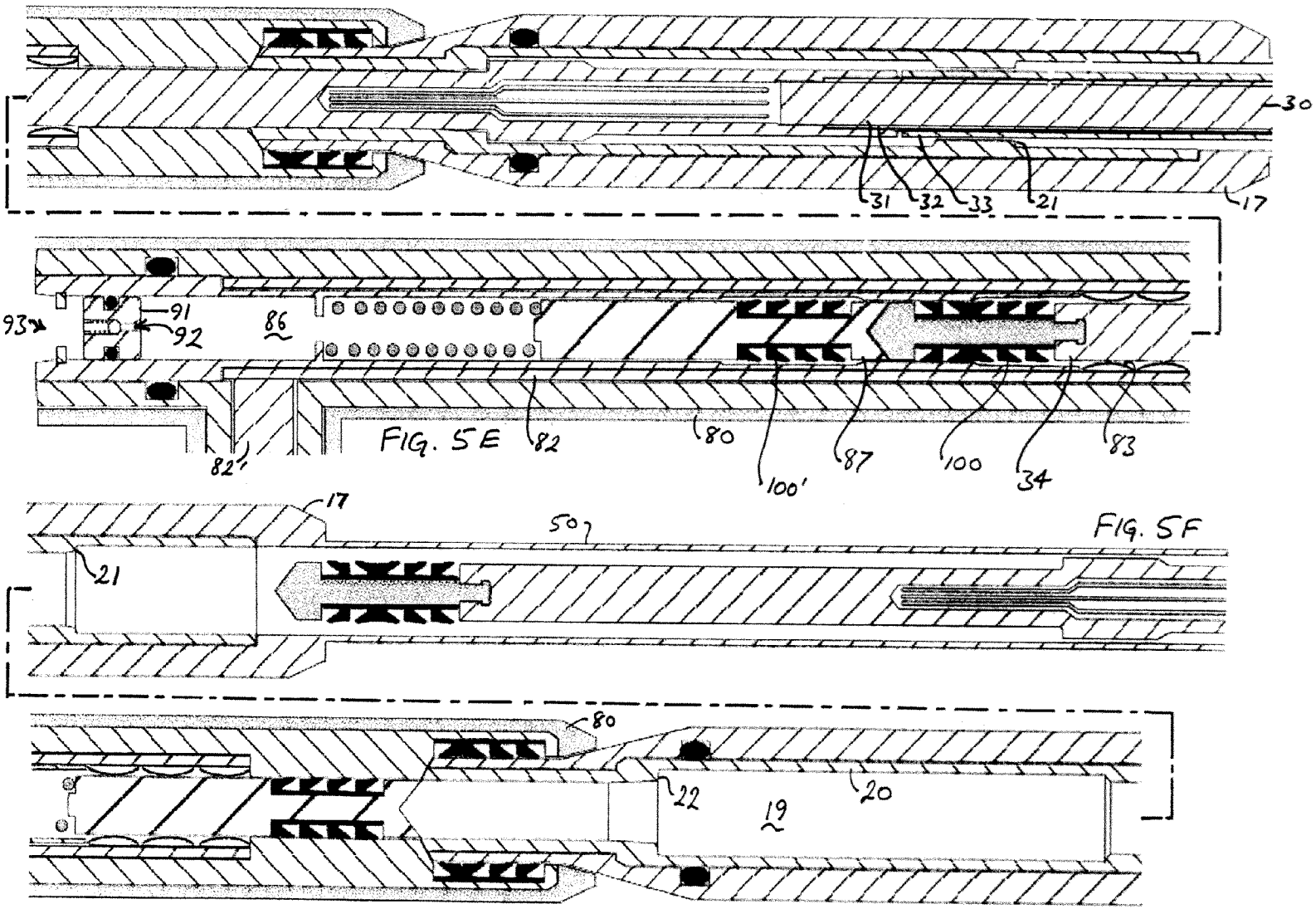

After each receptacle 80 of the ESP 70 is connected to the corresponding conduit 50 (FIG. 5D), deployment is resumed so that the weight of the conductor applies an increased axial load against the collar 39 resting on the upper internal shoulder 21. When the load reaches a threshold value, for example, about 200 kg, the leaf springs 38 are elastically deflected inwardly into the bore 36, allowing the collar 39 to slip past the shoulder 21. This releases the conductor 30 which slides down the conduit 50 until it reaches a second position (FIG. 5E) in which the collar 39 abuts against the lower internal shoulder 22. As it slidingly advances along the conduit from the first to the second position, the terminal portion comprising contact 34 extends from the nose 18 of the connection block 17 so that its tip 35 abuts against the plug 87, urging it hack along the fluid passage 86 until the contact 34 is electrically connected to the connectors 83 via the fluid passage 86 as shown in FIG. 5E. The connected position is sensed from the surface by a reduction in the tensile load on the deployment apparatus and by the electrical continuity between the conductors, following which each conductor 30 is energised to supply power to the motor 75 of the ESP via the tubular conductor 82 and cabling 82'.

In the connected position (FIG. 5E) the second group of seals 100' are positioned within one of the recesses 85 of the liner 84, so that they do not contact the liner, while those of the first group of seals 100 which face backwardly towards the orifice 89 of the receptacle are positioned within another of the recesses 85, so that they also do not contact the liner. The remaining seals 100 do contact the liner 84, but since they face forwardly towards the plug 87, they allow fluid to flow past them in that direction (i.e. away from the orifice 89 and towards the plug 87) but not in the opposite direction.

With the conductor 30 in the connected position, the clearance gap 52 and the fluid passage 86 thus form a continuous fluid pathway which is preferably filled with a dielectric oil 99 or other protective fluid.

The fluid passage 86 communicates with one side of a piston 91, which is exposed on its other side to the ambient fluid in the wellbore. The piston thus forms a pressure balancing element for equalising fluid pressure within the fluid passage 86 with ambient pressure in the borehole, preventing contamination of the fluid passage by well fluids. A non-return valve 92 is provided in the piston 91, through which the fluid passage 86 communicates with an outlet 93 to the borehole. This allows the dielectric oil 99 to be supplied to the deployed equipment by pumping it from the upper end 4 of the borehole, down the clearance gap 52 of the conduit 50, through the slits 37 past the collar 39, and around and past the contact 34 at the lower end of the conductor and out through the valve 92, flushing out any contaminating wellbore fluids which could otherwise compromise the insulation of the conductors proximate the point of connection. Of course, the dielectric oil may effectively protect the connection by surrounding the conductor in the region of the connection, even where the fluid passageway does not extend entirely around the axial tip of the terminal portion.

It is also possible to pump a protective fluid down the conduit 50 during connection, so as to displace ambient wellbore fluids and particulates from the region of the receptacles 80 and provide a temporary protective envelope within which the connection is made.

Figure 6:
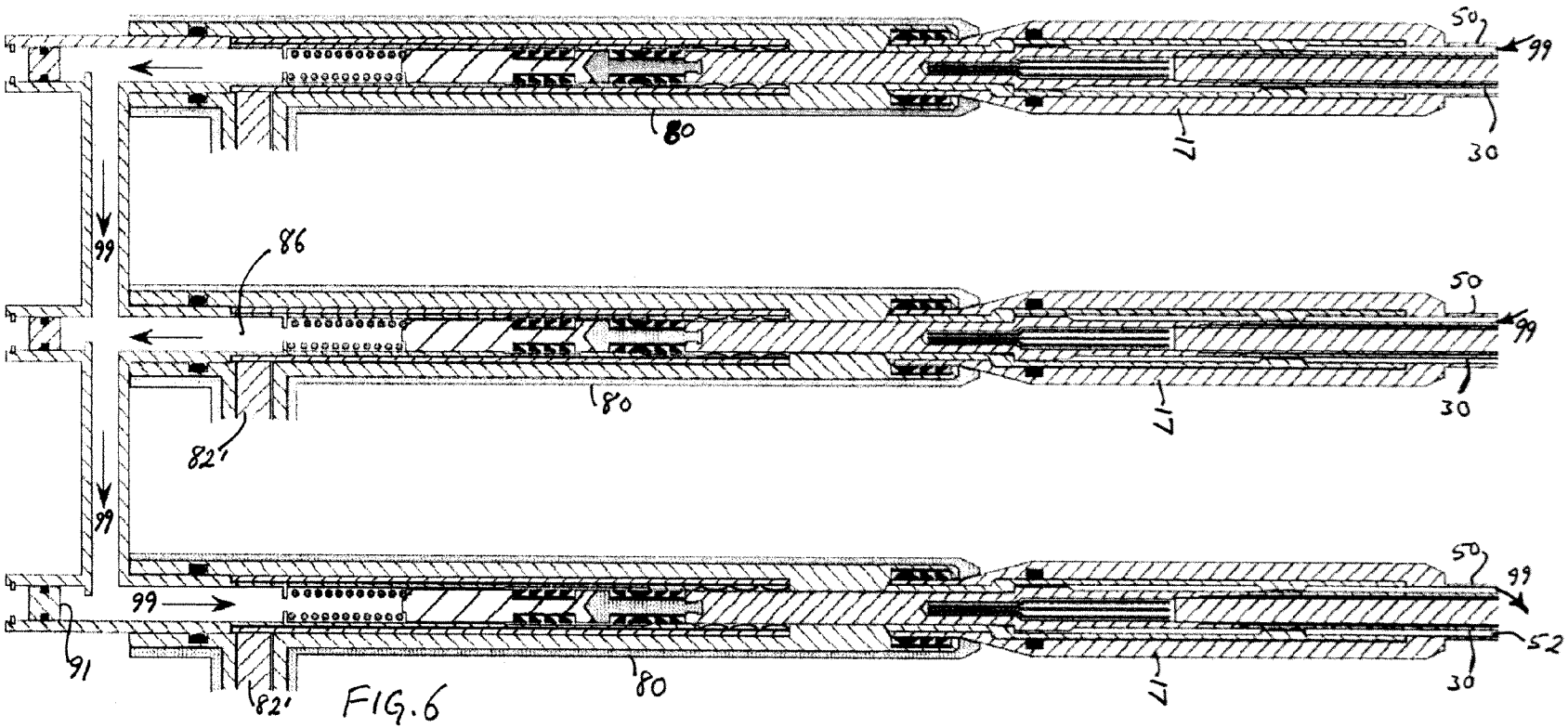
FIG. 6 is a longitudinal section in accordance with the first embodiment, showing fluid circulation through three conduits engaged with three interconnected receptacles of the ESP with the respective conductors in the connected position.

Referring to FIG. 6, in a development, the seals are arranged to permit dielectric oil 99 to flow through each fluid passage 86 in both directions when each respective conductor is connected, and the three respective fluid passages 86 are interconnected. This makes it possible to circulate dielectric oil 99 from the upper end of the borehole down one conduit 50, through the equipment 70 and back up another conduit 50. By selecting the circulation pattern and observing the condition of the fluid returning from the ESP or other deployed equipment, it is possible to detect contamination or damage to the conductors proximate the point of connection, as well as ameliorating such damage by surrounding the conductor with fresh dielectric oil, which displaces conductive wellbore fluids and prevents or reduces electrical tracking.

Figure 7:
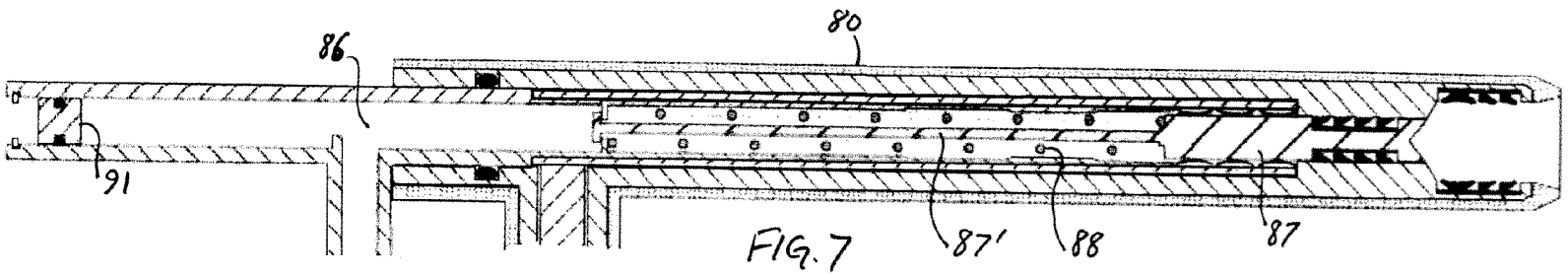
FIG. 7 is a longitudinal section through a receptacle of the ESP according to a variant.

Referring to FIG. 7, in a development, each plug 87 may be restrained in the closed position against the restoring force of the spring 88 by a stem 87' which engages an internal abutment surface in the fluid passage 86.

Figure 8:
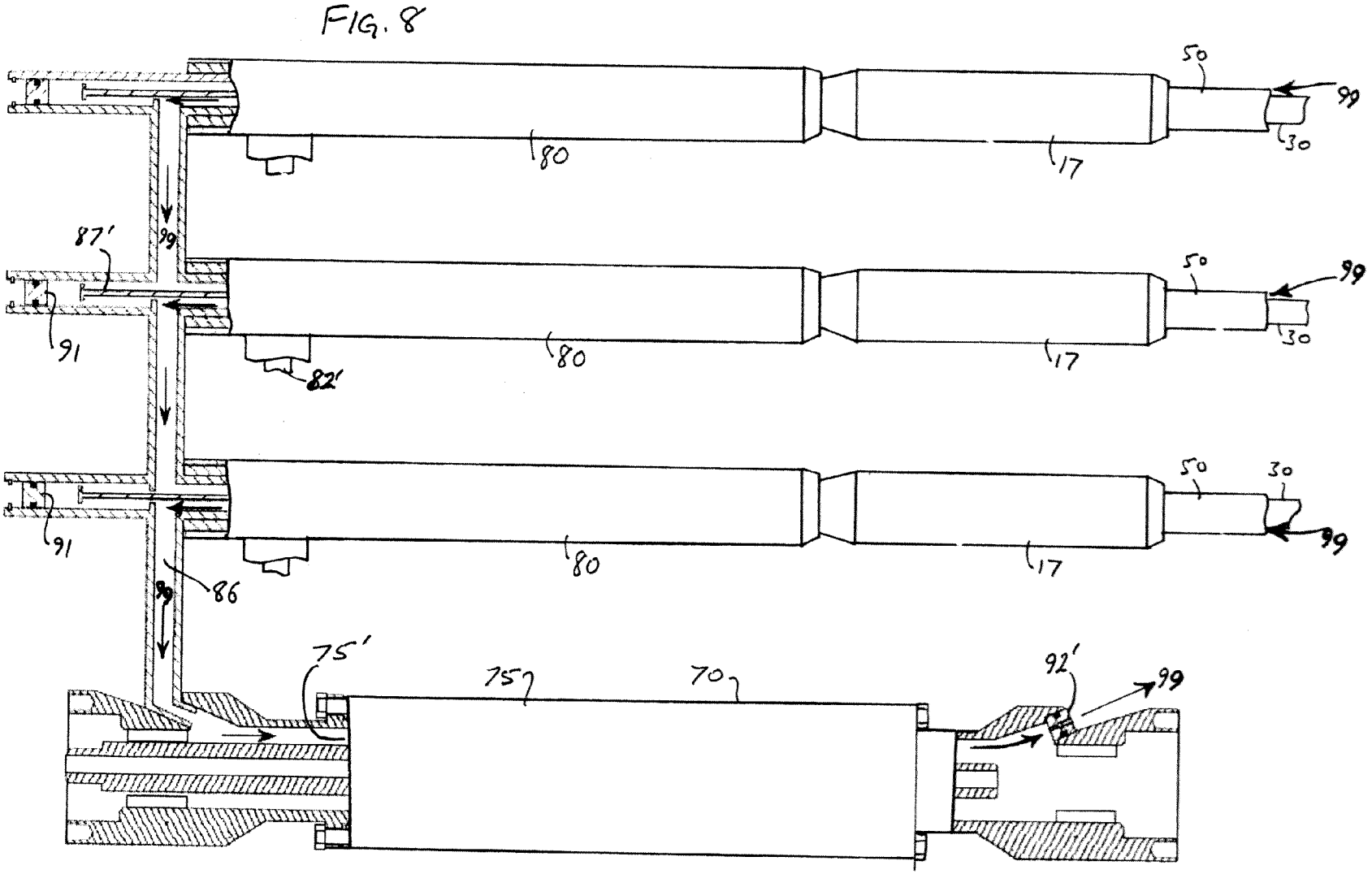
FIG. 8 shows fluid flow through the ESP and three conduits engaged with three interconnected receptacles of the ESP in accordance with the variant of FIG. 7.
Figure 9A:
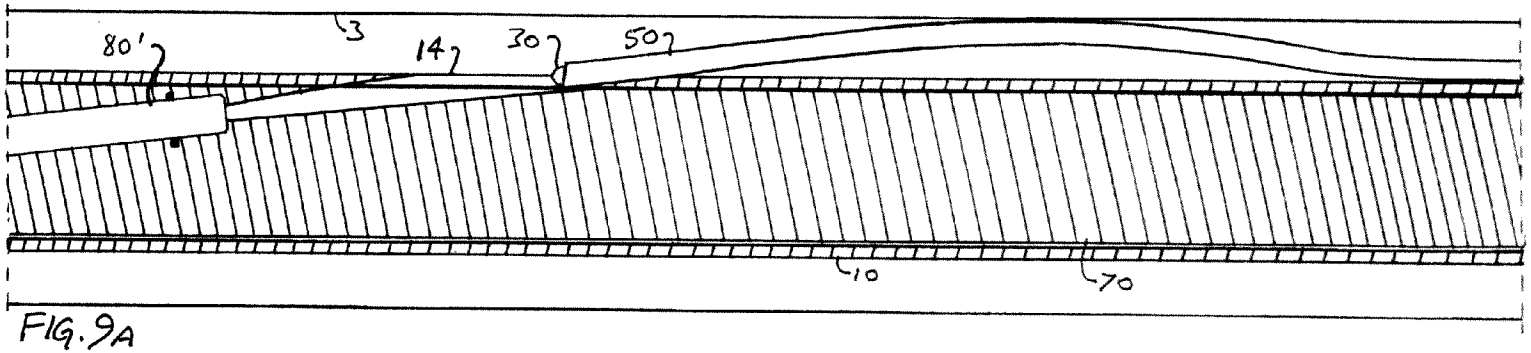
FIGS. 9A-9E are longitudinal sections through an ESP and tubing in the deployed position in accordance with a second embodiment, showing respectively.
Figure 9B:
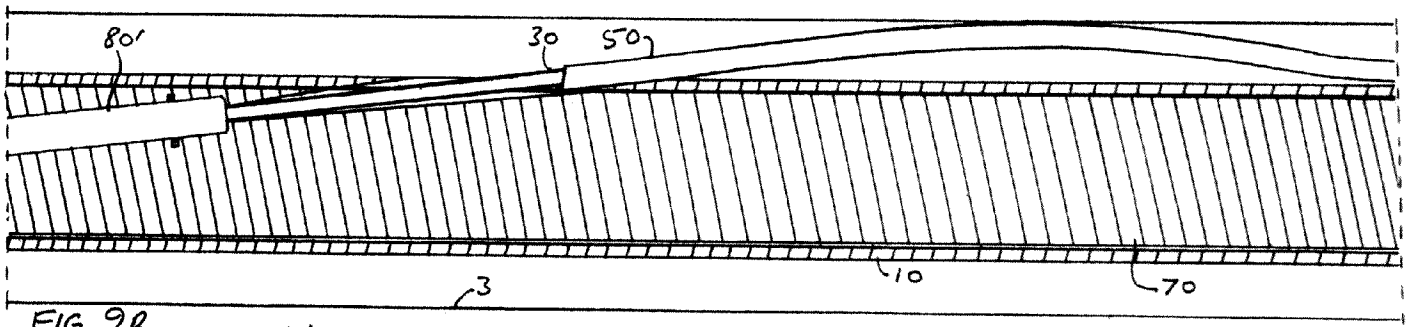
Figure 9C:
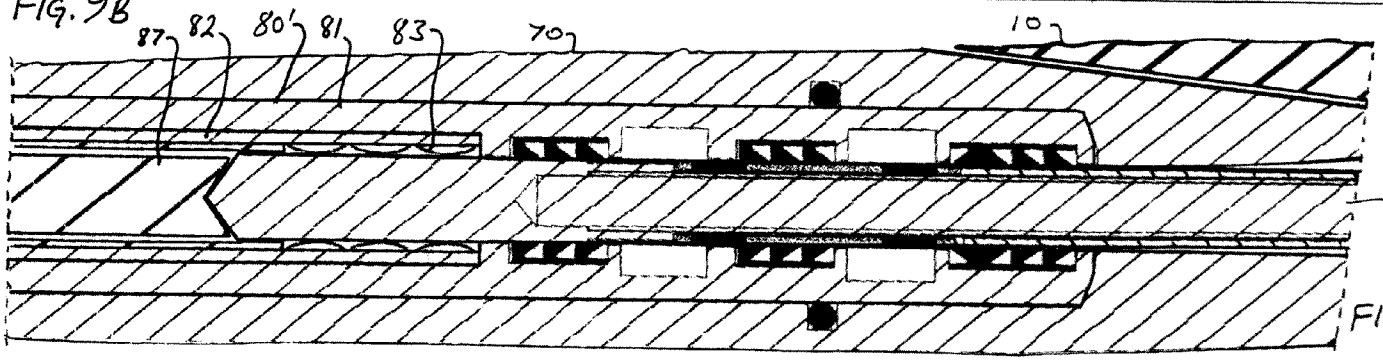
Figure 9D:
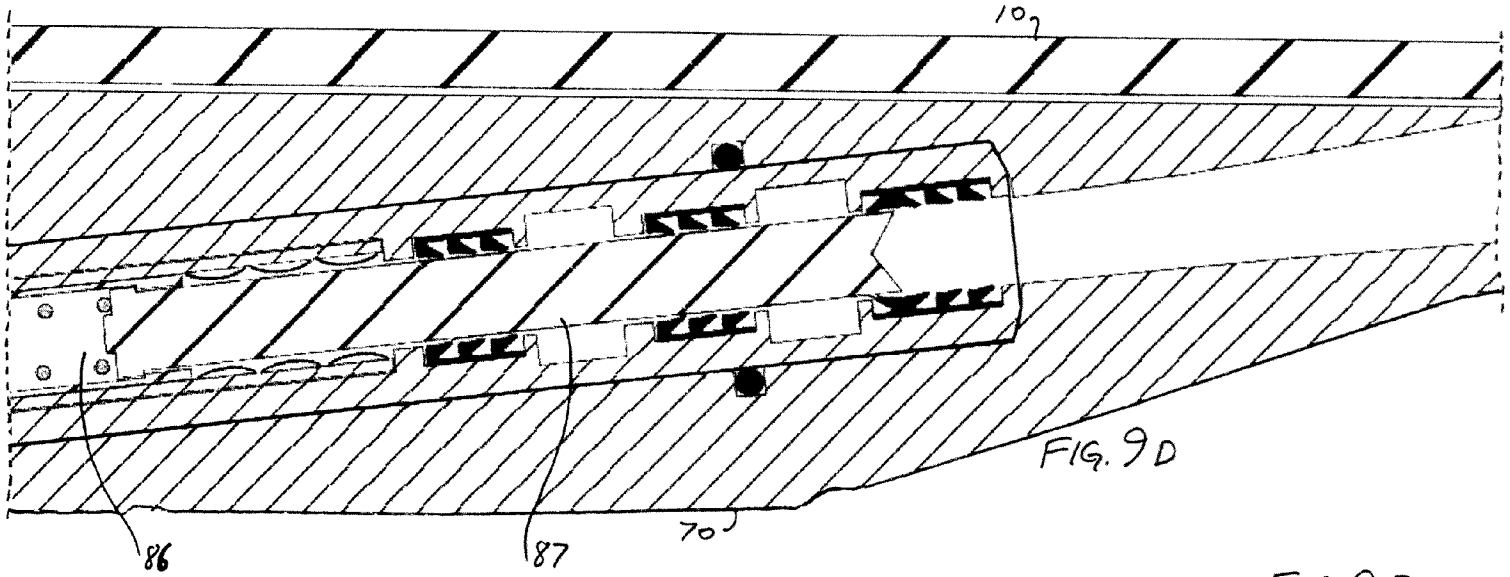
Figure 9E:
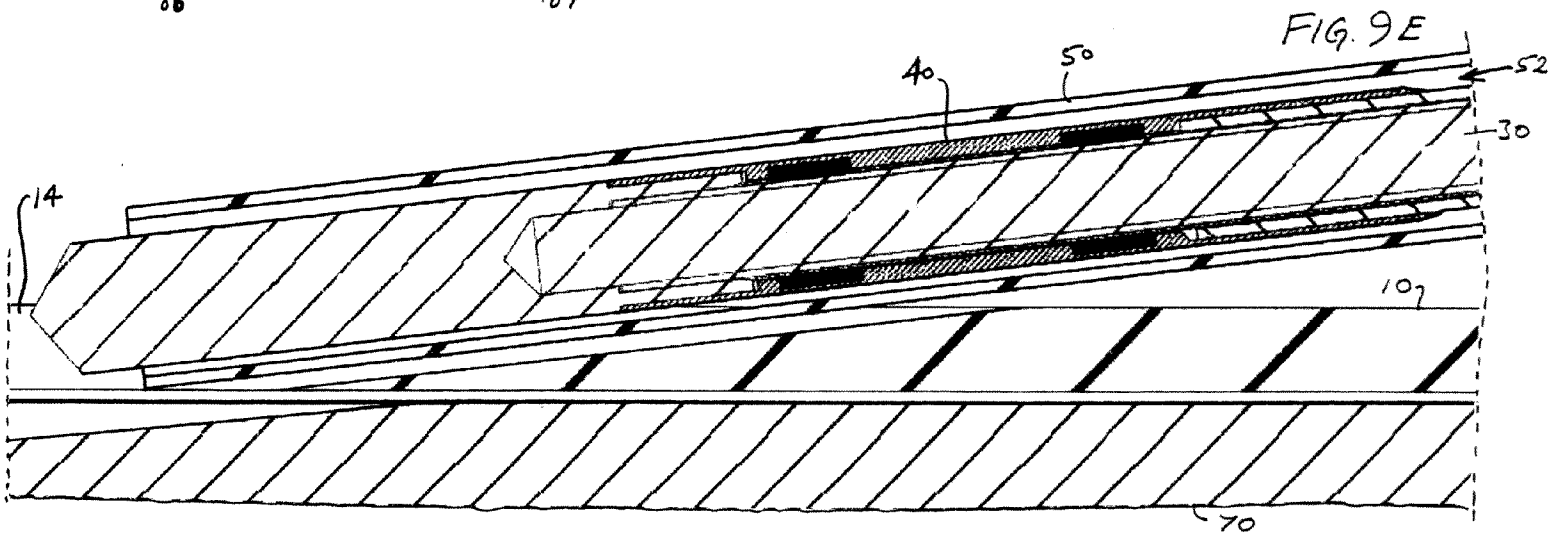

Referring to FIG. 8, the fluid passages 86 of the three respective receptacles may be interconnected and communicate with interstices 75' of the motor 75 or other electrically powered mechanism of the ESP or other deployed equipment. This allows dielectric oil 99 to be pumped down the conduits 50 and through the motor of the ESP, before it exits to the wellbore via a non-return valve 92' in the motor casing. In this way the motor can be replenished with dielectric oil in situ, prolonging its service life.

Referring to FIG. 5F, when damage is detected to the conductors, each conductor can be withdrawn individually and completely from the conduit 50 via the wellhead assembly 5 (the collar 39 being pulled past the shoulder 21), and then inspected, repaired, and re-deployed and re-connected simply by lowering it back down the conduit. During this entire operation, the conduit 50 preferably remains connected to the corresponding receptacle 80 so that the third group of seals 100" prevent the ingress of wellbore fluid to either the receptacle or the conduit.

If it is desired to recover the ESP 70 or other deployed equipment, the conductor is first withdrawn to the first position (sensed by the change in tensile load as the collar 39 engages the shoulder 21), in which the first seals 100 seal the lower end of the conduit. As the conductor is withdrawn, the plug 87 closes the fluid passage 86. The connection arm 71 carrying the receptacles 80 can then be retracted and the ESP recovered on a wireline.

Each conductor is thus remotely connectable to and disconnectable from the equipment while the equipment is in the deployed position, while both the equipment and the conductor are deployable and recoverable via the upper end of the borehole, each independently of the other. Advantageously, both sides of the electrical connection point may be remotely monitored, recovered, inspected, repaired and re-deployed, without contaminating the assembly, and can also be flushed with clean dielectric fluid via the conduit after re-assembly.

Referring to 9A-9E, in a second embodiment, the conduit 50 is fixed to the tubing 10 proximate the window 14 but is not connected to the ESP 70. Instead, with the ESP in the deployed position as shown, the conductor 30 is slidingly advanced from the lower end of the conduit so that it passes through the window 14 in the production tubing and enters into the receptacle 80', which is generally similar to the receptacle 80 already described. By arranging the conduit at an oblique angle with respect to the tubing 10 as shown, the connection may be obtained merely by advancing the conductor 30 from the conduit, and without any movement of either the conduit 50 or the receptacle 80', which provides a simplified assembly. Although in this embodiment the dielectric oil cannot be supplied to the receptacle, it can still be flushed through the conduit 50, and both sides of the connection (conductor and receptacle) can be recovered to the surface for inspection and repair. An insulating ceramic sleeve 40 is provided near the distal end of the conductor 30 to protect the insulation in the region which is projected from the conduit.

Figure 11A:
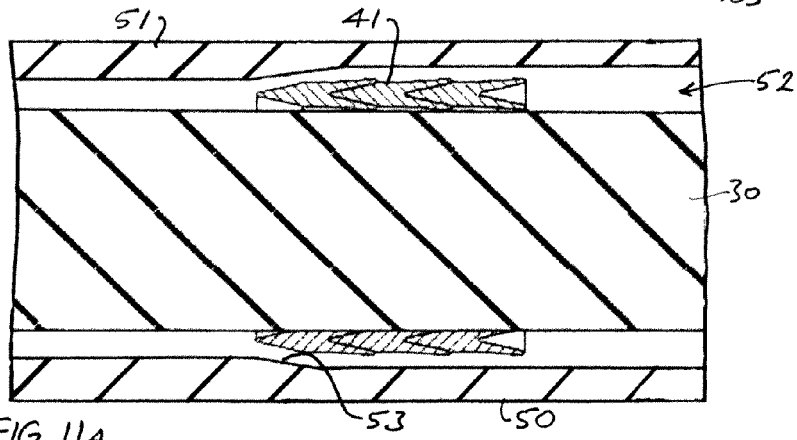
FIGS. 11A and 11B are longitudinal sections through a second assembly of seal elements arranged in the clearance gap between the conductor and the conduit, positioned respectively at an internal shoulder of the conduit and at the lower end of the conduit.
Figure 11B:
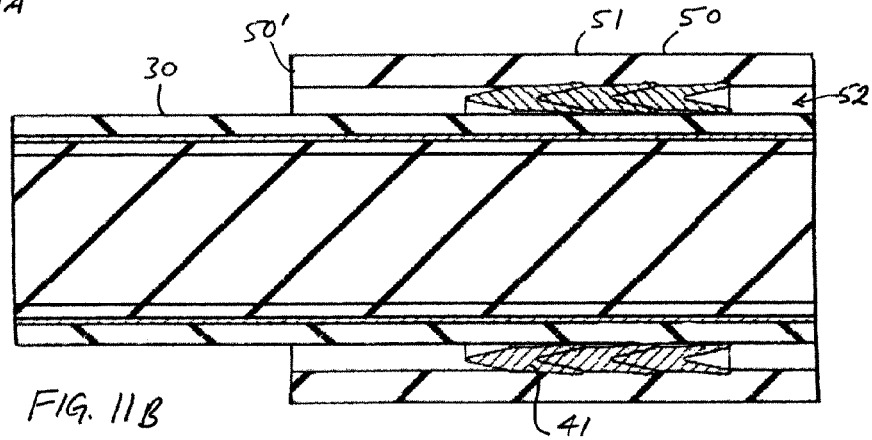

Referring also to FIGS. 11A and 11B, in accordance with the second embodiment, the clearance gap 52 may be selectively sealed proximate the locating structure 11 and the distal end 50' of the conduit 50 by a seal assembly 41, which may comprise an axial stack of annular seals. The seal assembly may be selectively engaged with the inner wall of the conduit 50 by sliding the conductor 30 down the conduit until the seal assembly reaches an internal shoulder 53 in the conduit and enters a reduced diameter portion at its lower end region 51. As the conductor is withdrawn from the conduit, the seal assembly clears the reduced diameter portion, allowing the conductor to be withdrawn freely.

Figure 10:
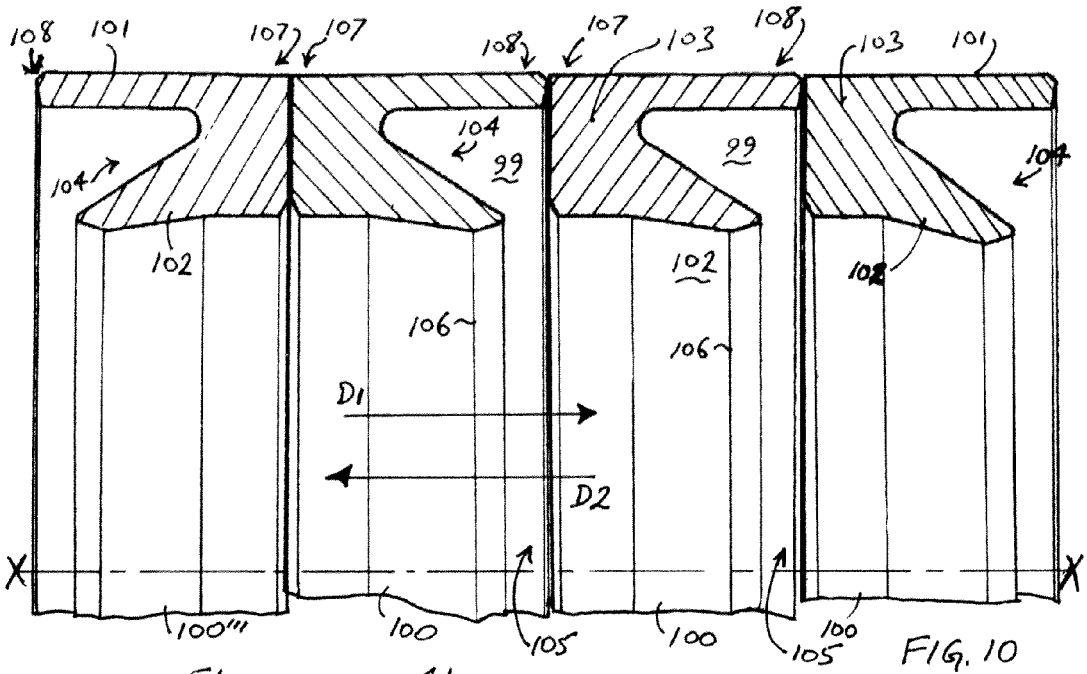
FIG. 10 is an enlarged longitudinal section through part of an assembly of seal elements.

Referring to FIG. 10, each seal 100 (100', 100") functions as a wiper and comprises an annulus, of which approximately one quarter is shown in the drawing, the seals optionally being stacked along their longitudinal axis X-X to form a seal assembly. The radially outer wall 101 and inner wall 102 of each seal are joined in the region of the first axial end 107 of the seal by a solid portion 103, and are separated in the region of the opposite, second axial end 108 by an annular recess 104. The outer wall 101 extends further in the axial direction towards the second end 108 than the inner wall 102, so that when the seals are stacked in axial abutment as shown and facing in the same direction, the outer wall of each seal abuts against the outer wall of the adjacent seal while the inner walls 102 are separated by a gap 105. This gap allows the radially inner lip 106 of the inner wall 102 to deflect slightly radially outwardly so as to permit fluid flowing in the direction D1 from the first end 107 towards the second end 108, creating a pressure differential across the inner wall 102 whereby the pressure against the radially inner side of the inner wall 102 is greater than that in the recess 104, to flow past the seal 100. Fluid urged against the seal in the opposite direction D2 creates an opposite pressure differential, with the pressure in the recess 104 being greater than on the radially inner side of the inner wall 102, which tends to urge the lip 106 against the cylindrical surface of the component (not shown) around which the seal is fitted, preventing the fluid from flowing past the seal 100. The seals 100 (100', 100") wipe wellbore fluid from the surface of the conductor as it enters the receptacle and retain dielectric oil in the spaces between them.

In summary, according to a preferred embodiment a wet connection system suitable for use in hydrocarbon wells comprises one or more elongate, small diameter conduits which extend down the wellbore and terminate adjacent a locating structure on the production tubing. Equipment deployed at the locating structure is connected to one or more self supporting conductors which extend down the conduits from the wellhead. Preferably the conductors are retractable and the conduits are sealingly connected to the equipment, allowing the equipment and conductors to be deployed and recovered independently of each other and to be flushed with dielectric oil pumped down the conduits after re-connection.

Although in the described embodiments the deployed equipment is an ESP, it will be understood that the apparatus may be used to connect any equipment deployed in a borehole to an electrical conductor, a fibre-optic conductor, a conductor of pressurised hydraulic fluid, or any other sort of conductor that connects the equipment to the surface. By way of example, such equipment may comprise a valve mechanism, an orienting tool, a remote sensing tool, or the like. One, two, three or more conduits may be provided, and each conduit may contain one conductor or a group of conductors. The conductors and conduits may be round or non-round in cross section. Instead of a steel connection block 17 with an internal ceramic sleeve 20, the entire connection block could be made of ceramic material, so as to better resist electrical tracking. The conduits 50 could be made of any suitable metal or alternatively of ceramic or other non-conductive material instead of steel. Preferably, the ends of the bores housing the seals comprise chamfers (not shown) to assist the seals to enter into the bores when extending or retracting the conductor. Rather than unidirectional or stacked seals, "O" rings or other conventional seals might be used.

Rather than arranging the locating structure and the conduit on production tubing or other recoverable tubing deployed down the wellbore, the locating structure and the conduit might alternatively be arranged on tubing forming part of the fixed well casing, in which case the conduit may be permanently fixed in the borehole. Instead of attaching the connection blocks 17 in fixed relation to the production tubing, the connection block or the lower end of the conduit may be movably, e.g. pivotably supported on the tubing, for example, so as to more easily align it with the corresponding connection structure of the deployed equipment, or may be extendable and retractable so as to engage it actively with a fixed or movable connection portion of the ESP or other equipment.

In less preferred embodiments, the or each conductor may be permanently fixed in the conduit, for example, by means of spacer elements which permit protective fluid to flow through the clearance gap. By pumping dielectric oil down the conduit during or after connection of the conductor to the deployed equipment, insulation faults occurring at the lower end of the conductor may be ameliorated.

In yet further alternative embodiments, the tubing need not include a locating structure, the equipment and the conductor being deployed independently to an arbitrary deployed position (in which the equipment is secured, e.g. by means of a remotely expanded packer), before connecting the conductor in-situ to the equipment.

In the illustrated embodiment, the connector of the tool comprises a receptacle which forms part of the fluid passageway. In alternative embodiments for example, the tool may comprise a connector which extends outwardly from the tool and which is received in the lower end portion of the conduit when the conduit is sealingly connected to the tool, so that the fluid passageway extends around the connector to an outlet provided in the conduit or in the casing of the tool.

Instead of arranging the conduit in fixed relation to the production tubing or well casing, the conduit may instead be sealingly connected to the equipment before the equipment and conduit are deployed together down the borehole. Once in its deployed position, the self-supporting conductor is then slidingly advanced down the conduit until its terminal portion enters the receptacle in the equipment. Dielectric fluid is then pumped down the clearance gap between conductor and conduit so that it flushes the electrical connection, flowing through the fluid passageway defined by the receptacle and out through a non-return valve or other outlet, optionally after also flushing through the electrical coils or other internal components of the equipment.

In a yet further embodiment, the tool or equipment may be suspended on continuous coiled tubing (CT) or alternatively on jointed production tubing, and advanced together with the tubing into the borehole. The conduit and conductor may then be deployed together down inside the CT or production tubing, the conduit terminating in a connector which enters and mechanically (optionally, releasably) engages in a cooperating locking formation on the top of the equipment as known in the art. The conductor can be inserted into the conduit either before or after the conduit is sealingly connected to the tool. Once the conduit is sealingly locked to the equipment, the conductor is slidingly advanced down the conduit to connect with the connector of the tool, and the dielectric fluid is then pumped down through the clearance gap to flush through the fluid passageway (defined for example by a receptacle containing the electrical connection), again exiting via a non-return valve or other outlet, either into the wellbore or back up to the surface via a second or third conduit containing a second or third conductor. This allows the tool to be deployed on CT or a wireline, and then the conduit and conductor to be engaged, and then the electrical connection to be flushed, and if necessary the conductor to be withdrawn and replaced and the connection flushed through again, without disturbing the tool.

The conduit and conductor can then be withdrawn and replaced by a wireline for recovering the tool with high tension force.

It is to be understood that the scope of the invention is limited solely by the claims and not by the features of the illustrative embodiments herein described.

What is claimed is:

1. A system for remotely connecting a conductor to equipment deployed down a borehole, including tubing extending down the borehole from an upper end of the borehole, the equipment being deployable through the tubing to a deployed position;

a locating structure disposed on the tubing for receiving the equipment and supporting it in the deployed position; and at least one elongate conductor extending from the upper end of the borehole and including a terminal portion, the terminal portion being remotely connectable to and disconnectable from the equipment when the equipment is in the deployed position;

wherein at least one elongate tubular conduit is arranged in fixed relation to the tubing, the conduit extending from the upper end of the borehole and including a lower end portion, the conduit being sealingly connectable to and disconnectable from the equipment when the equipment is in the deployed position, the lower end portion being fixed proximate the locating structure;

the conductor being disposed inside the conduit, a clearance gap being defined between the conductor and the conduit.

2. A system according to claim 1, wherein the conductor is connectable to and disconnectable from the equipment while the conduit is sealingly connected to the equipment.

3. A system according to claim 1, wherein the conductor is slidably disposed inside the conduit.

4. A system according to claim 3, wherein the conductor is slidably removable from the conduit via the upper end of the borehole.

5. A system according to claim 3, wherein the terminal portion of the conductor is connectable to the equipment by sliding extension of the conductor from a lower end of the conduit.

6. A system according to claim 3, wherein an abutment mechanism is provided for supporting the conductor in a first position in the conduit against an axial load applied to the abutment mechanism by the conductor, the abutment mechanism being releasable by an increase in the axial load to permit the conductor to slide down the conduit to a second position; and wherein when the equipment is located in the deployed position, in the first position the conductor is not connected to the equipment, and in the second position the conductor is connected to the equipment.

7. A system according to claim 1, wherein the conductor is a self supporting electrical conductor.

8. A system according to claim 7, wherein the conductor includes a core and an electrically conductive cladding, the cladding having lower tensile strength than the core.

9. A system according to claim 1, wherein the clearance gap is filled with a protective fluid.

10. A system according to claim 1, wherein the clearance gap is sealed proximate the locating structure.

11. A system according to claim 1, wherein the borehole includes a fixed casing defining a wellbore, and the tubing is deployed within the wellbore.

12. A system according to claim 1, wherein at least two said conduits extend from the upper end of the borehole to the locating structure, each conduit having a respective said conductor disposed therein so as to define a respective said clearance gap therebetween.

13. A system according to claim 12, wherein each conduit is sealingly connectable to the equipment in the deployed position, and the equipment includes at least two interconnected fluid passages which communicate with the respective clearance gaps when the equipment is connected to the respective conduits.

14. A system for remotely connecting a conductor to equipment deployed down a borehole, including tubing extending down the borehole from an upper end of the borehole;

the equipment being deployable through the tubing to a deployed position;

a locating structure disposed on the tubing for receiving the equipment and supporting it in the deployed position; and at least one elongate conductor extending from the upper end of the borehole and including a terminal portion, the terminal portion being remotely connectable to and disconnectable from the equipment when the equipment is in the deployed position;

wherein at least one elongate tubular conduit is arranged in fixed relation to the tubing;

the conduit extending from the upper end of the borehole and including a lower end portion;

the lower end portion being fixed proximate the locating structure;

the conductor being disposed inside the conduit;

a clearance gap being defined between the conductor and the conduit; and wherein the conduit is sealingly connectable to the equipment in the deployed position to define a fluid passage which communicates with the clearance gap when the equipment is connected to the conduit.

15. A system according to claim 14, wherein the fluid passage extends around the terminal portion of the conductor when the conductor is connected to the equipment.

16. A system according to claim 14, wherein the equipment includes an electrically powered mechanism, and the fluid passage extends through the mechanism.

17. A system according to claim 14, wherein the fluid passage communicates with a pressure balancing element for equalising fluid pressure within the fluid passage with ambient pressure in the borehole.

18. A system according to claim 14, wherein the fluid passage communicates with an outlet to the borehole via a non-return valve.

19. A system according to claim 14, wherein the conduit is sealingly connectable to and disconnectable from the equipment when the equipment is in the deployed position.

20. A method of making a remote connection between a terminal portion of a conductor and a submersible tool deployed in a borehole, the tool including a connector for connecting the tool to the terminal portion of the conductor; the method including:

arranging the conductor within an elongate tubular conduit so as to define a clearance gap between the conductor and the conduit;

sealingly connecting the conduit to the tool to define a fluid passageway communicating with the clearance gap and with the connector;

providing an outlet from the fluid passageway; and after connecting the conduit to the tool, slidingly advancing the conductor along the conduit until the terminal portion of the conductor connects with the connector;

pumping a protective fluid through the clearance gap of the conduit, through the fluid passageway and out of the outlet.

21. A method according to claim 20, wherein the outlet comprises a non-return valve and the protective fluid is expelled via the valve into the wellbore.

22. A method according to claim 20, wherein the outlet communicates with a second said conduit and the protective fluid is circulated back up the second said conduit to an upper end of the borehole.

23. A method according to claim 20, wherein the protective fluid is pumped through a mechanism of the tool.

* * * * *

UNITED STATES PATENT AND TRADEMARK OFFICE

CERTIFICATE OF CORRECTION

PATENT NO. : 8,746,354 B2
APPLICATION NO. : 13/014055
DATED : June 10, 2014
INVENTOR(S) : Philip Head It is certified that error appears in the above-identified patent and that said Letters Patent is hereby corrected as shown below:

In the Specification

Column 6, line 4: change “rain” to --ram--.

Signed and Sealed this
Eleventh Day of November, 2014

Michelle K. Lee

Michelle K. Lee
*Deputy Director of the United States Patent and Trademark Office*